United States Patent [19]

Gehl

[11] 4,434,901

[45] Mar. 6, 1984

[54] SAFETY APPARATUS FOR CRANES

[76] Inventor: Paul O. Gehl, P.O. Box 303, Hilbert, Wis. 54129

[21] Appl. No.: 283,495

[22] Filed: Jul. 15, 1981

[51] Int. Cl.[3] ..... B66C 15/00

[52] U.S. Cl. ..... 212/153; 256/1; 256/23; 293/1; 340/61; 340/685

[58] Field of Search ..... 256/1, 23, DIG. 6; 280/762, 770; 293/1, 118, 119, 127, 138; 116/28 R; 340/61, 548, 668, 685, 686; 212/153, 157, 182, 149, 151

[56] References Cited

U.S. PATENT DOCUMENTS

| | | | |
|---|---|---|---|
| Re. 15,927 | 10/1921 | Schauman | 280/770 |
| 378,876 | 3/1888 | Dooley | 340/61 |
| 1,376,166 | 4/1921 | Rosenberg | 340/61 |
| 1,594,298 | 7/1926 | Pless | 340/61 |
| 2,207,406 | 7/1940 | Jones | 340/61 |
| 2,843,689 | 7/1958 | Roberts | 340/61 |
| 3,256,998 | 6/1966 | Laharty | 212/153 |
| 3,395,387 | 7/1968 | Durant | 340/61 |
| 3,443,658 | 5/1969 | Culp | 180/96 |
| 3,560,922 | 2/1971 | Wilson | 340/61 |
| 3,664,701 | 11/1970 | Kondur | 340/61 |
| 3,782,766 | 1/1974 | Teel | 256/1 |
| 3,812,978 | 5/1974 | Roland et al. | 212/182 |
| 4,020,918 | 5/1977 | Houskamp et al. | 180/79 |
| 4,027,130 | 5/1977 | Filip | 200/161 |
| 4,137,984 | 2/1979 | Jennings et al. | 180/98 |

FOREIGN PATENT DOCUMENTS

| | | | |
|---|---|---|---|
| 220491 | 2/1960 | Austria | 116/28 R |
| 53-147499 | 12/1978 | Japan | 340/548 |
| 23506 | of 1909 | United Kingdom | 340/548 |

*Primary Examiner*—Sherman D. Basinger
*Assistant Examiner*—Thomas J. Brahan
*Attorney, Agent, or Firm*—Merchant, Gould, Smith, Edell, Welter & Schmidt

[57] ABSTRACT

Safety apparatus is disclosed for a crane including a crane body that rotatably swings about a substantially vertical axis about an undercarriage that moves on endless tracks. The crane body has opposed sides, a front end and back end, and a crane boom projects forwardly from the front end. The safety apparatus includes a length of cable that is supported in spaced relation from the crane body, extending around a portion of its periphery consisting of the crane body sides and back end. The cable is supported in such a manner that it may be laterally deflected, by a person or object, which alters its effective length. The safety apparatus further includes a control device that is operably connected to the cable for generating an electrical alarm signal in response to cable deflection, and an audible alarm connected to the control means for generating an audible alarm in response to the alarm signal.

19 Claims, 7 Drawing Figures

SAFETY APPARATUS FOR CRANES

TECHNICAL FIELD

The invention broadly relates to safety apparatus for heavy-duty equipment, and is specifically directed to safety apparatus for avoiding accidents with cranes that pivotally swing about a vertical axis.

BACKGROUND OF THE INVENTION

The invention is specifically intended for use with conventional cranes having a crane body with a forwardly projecting boom that pivotally moves up and down for positioning purposes during crane operation. The crane body pivotally swings about a substantially vertical axis relative to an undercarriage that typically is movable on endless tracks.

Government regulations now require that many types of heavy equipment be provided with some type of safety apparatus to avoid accidents. As an example, many heavy machines that move during operations must include an intermittent audible alarm at any time they move in reverse, when the operator's view is neither direct nor complete.

In one type of crane, the crane body pivotally carries a forwardly projecting boom of substantial length, and a counter-weight is mounted to the opposite end of the crane body for balance purposes. The operator faces the direction of boom projection, and for this reason has a clear view to avoid most problems involving the boom. However, this type of crane must of necessity pivotally swing about a substantially vertical axis about its undercarriage to position the boom in various places during operation, and the rear end of the crane body may create hazardous problems with respect to objects and persons that come into its path.

This problem has been approached in different manners in the prior art. As an example, barricades have been attached to the crane body which are outside its swing radius. However, this approach substantially increases the width of the entire crane to the point where it is extremely difficult to move.

As another example, separate barricades have been set up around the crane to keep objects and people outside the crane swing area. However, this involves considerable labor to set up and remove the barricades each time the entire crane is moved to a new position.

SUMMARY OF THE INVENTION

The subject invention uniquely solves this problem through the provision of safety apparatus that is mounted to and travels with the crane body, and which generates an instantaneous audible alarm for the operator in the event it engages or is engaged by an object or person in the swing area. More specifically, the invention comprises a length of cable that is carried by support means in spaced relation to the crane body, extending around both sides of the crane and its back end. This is the portion of the crane body for which the crane operator does not have a direct and clear view.

In the preferred embodiment, the support means comprises a plurality of eye bolt supports that are secured to the crane body and project outwardly. The cable is secured to one of the supports at one end, and at the opposite end is connected to control means in such a manner that, when engaged, the cable is laterally deflected and its effective length is shortened.

The control means in the preferred embodiment comprises an elongated member that is spring biased against movement to maintain the cable taut. The elongated member is connected through linkage means to an electromechanical switch that is normally open, so that lateral deflection of the cable causes it to close. The switch is connected with a suitable power source to an audible alarm in the cab of the crane so that the operator is immediately aware of any person or object striking or struck by the safety apparatus.

In the preferred embodiment, the cable also has a plurality of visual warning indicators connected along its periphery to alert persons in the area of possible danger.

The inventive safety apparatus thus provides a solution to the problem which is fully effective in deterring problems in the crane swing area, and which at the same time is simple, economical, easily installed and operated.

DETAILED DESCRIPTION OF THE INVENTION

Figure 1:
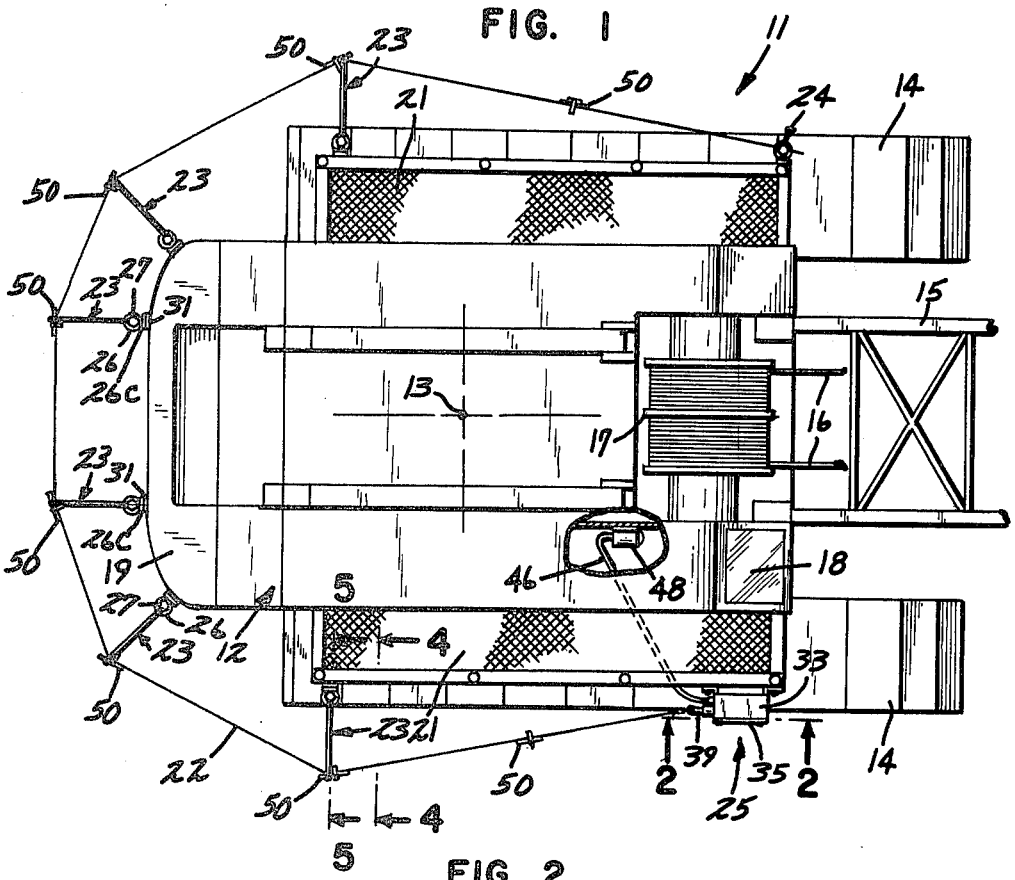
FIG. 1 is a fragmentary view in top plan of a crane capable of swinging movement on which the inventive apparatus is operably mounted, the Figure showing in particular an externally engageable cable extending around a substantial portion of the external periphery of the crane body.

With initial reference to FIG. 1, a crane represented generally by the numeral 11 is shown to comprise a crane body 12 that moves about a substantially vertical axis 13 relative to an undercarriage that is movable along the ground or other support surface by endless tracks 14. A crane boom 15 is pivotally connected to the crane body 12 for up and down swinging movement in a conventional manner, such movement being effected through cables 16 wound on a drum 17 by an operator within a protected cab 18 forming part of the crane body 12 with conventional control devices (not shown).

Because of the substantial length and weight of the boom at one end of the crane body 12, a heavy balance or counterweight 19 is secured to the opposite end of the crane body 12 to permit balanced operation. A catwalk 21 extends laterally from each side of the cab 18 and extends over a substantial portion of the length of the crane body 12.

As may be observed from the top plan view of the crane 11, the boom 15, cab 18, catwalk 21 and counterweight 19 together define an external periphery of the crane body 12 that moves about the axis 13 during crane operation. The inventive safety apparatus for the crane 11 comprises a cable 22 that extends around a substantial portion of the periphery of crane body 12 in spaced relation thereto in such a manner that it will be engaged by any object or person that the crane body 12 itself might otherwise strike. In the preferred embodiment, the cable 22 is a heavy, single-strand steel wire or a multistrand steel cable. Other materials could be used to perform the functions of tensile strength and substantial nonstretching provided by the cable 22. If engaged and laterally deflected, the effective length of the cable is altered, thus causing movement of a control member that actuates an audible alarm, all as discussed below.

As seen in FIG. 1, the cable 22 is supported in spaced relation from the crane body 12 by a plurality of support devices 23, 24, and by control means represented generally by the numeral 25.

Figures 3, 4, 5, 6, 7:
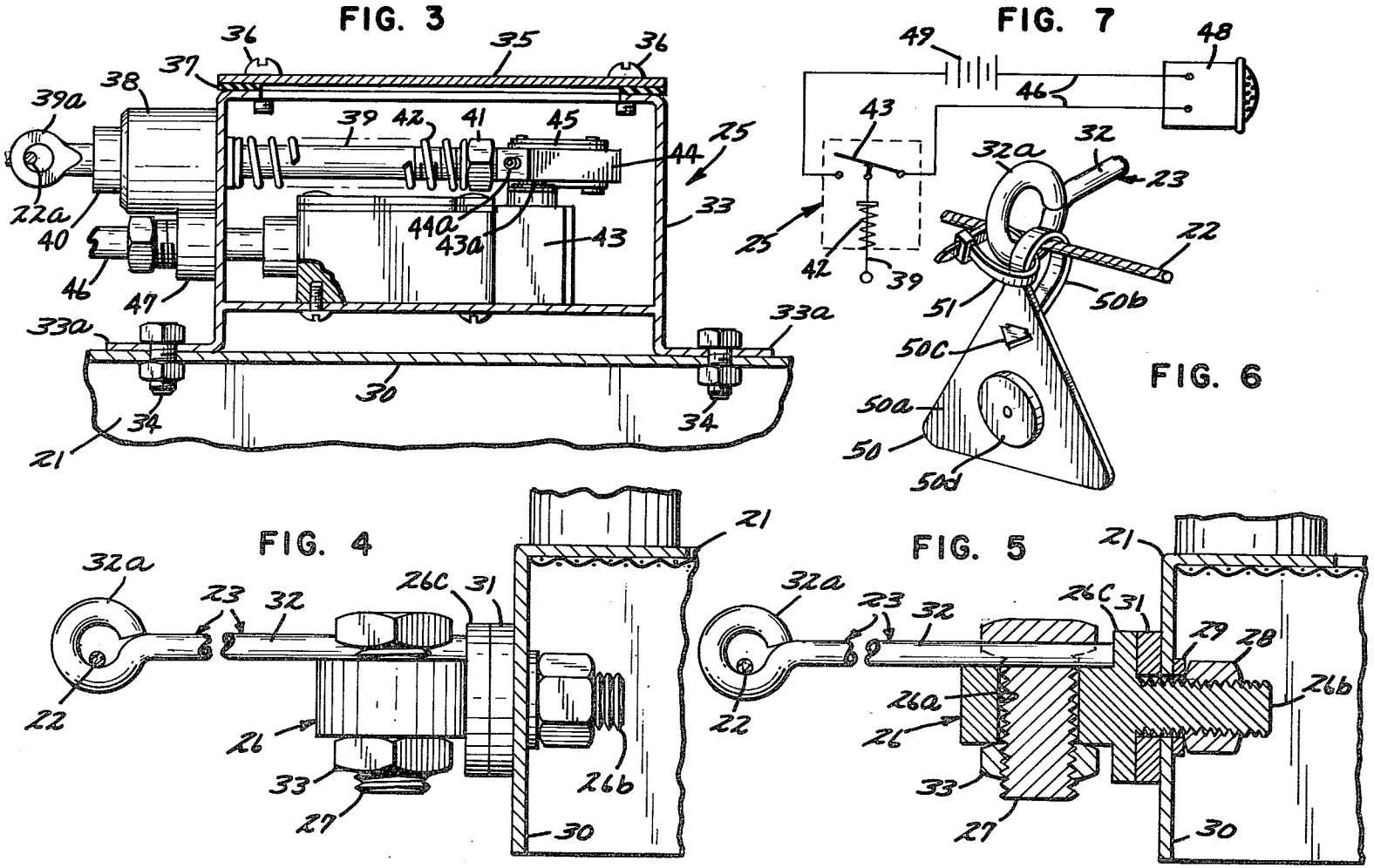
FIG. 3 is a sectional view of the control box taken along the line 3—3 of FIG. 2.
FIG. 4 is an enlarged fragmentary sectional view taken along the line 4—4 of FIG. 1, showing in particular one of several devices for supporting the cable in spaced relation to the crane body.
FIG. 5 is an enlarged fragmentary sectional view taken along the line 5—5 of FIG. 1 viewing the cable support device from a different sectional perspective.
FIG. 6 is an enlarged fragmentary perspective view of a visual warning device used in conjunction with the cable.
FIG. 7 is an electrical schematic diagram of the control circuit used for the inventive apparatus.

One of the support devices 23 is shown in FIGS. 4 and 5. The device 23 comprises a collar member 26 having a transverse aperture 26*a* sized to receive a threaded bolt 27. The collar member 26 further comprises a threaded projection 26*b* adapted to receive a nut 28 and lock washer 29, if used in connection with a thin plate 30 forming part of the frame, as shown in FIGS. 4 and 5. The threaded projection 26*b* obviously may also be used with a tapped bore in a solid frame member if necessary.

The collar member 26 also defines an abutment flange 26*c* that abuts a spacing washer 31 when the device is locked into place.

The threaded bolt 27 is formed with a transverse bore therethrough at its head end, which bore is sized to receive an eye bolt 32. The eye bolt 32 is held rigidly by tightening a nut 33 on the threaded bolt 27. The eye 32*a* of the eye bolt 32 is positioned to receive the cable 22, which extends generally horizontally relative to the ground.

The eye bolt 32 is relatively long as shown in FIG. 1, in order for the cable 22 to be spaced a relatively substantial amount from the crane body 12 along the rear peripheral portions thereof. As shown in FIG. 1, four supporting devices 23 are used along the back of the counterweight 19, and one each is secured to the rear corner of the catwalks 21.

The support device 24 is identical to the devices 23 except that it includes no eye bolt 32. Here, the cable 22 is simply inserted into the transverse bore of the threaded bolt 27, and the nut 33 is drawn tight to fix one end of the cable 22 and prevent its longitudinal movement. However, the cable 22 may slide relative to the eyes 32*a* of the support devices 23 upon engagement and lateral deflection, as will become apparent further below.

Figure 2:
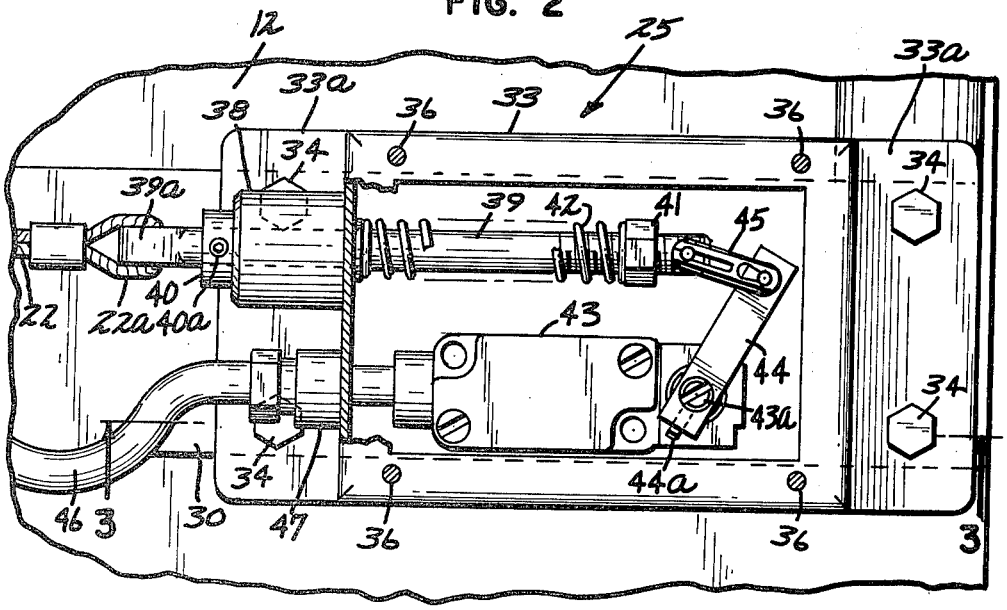
FIG. 2 is an enlarged fragmentary sectional view taken along the line 2—2 of FIG. 1, showing in particular a control box including a resiliently yielding device that moves in response to engagement of the cable and a switch actuated by such movement.

The control means 25 is secured to the catwalk 21 opposite that of the device 24 in a similar position. The control means 25 is shown in FIGS. 2 and 3 to comprise a rigid metal box 33 having a pair of end flanges 33*a* that are secured by bolts 34 to part of the frame of crane body 12 below the associated catwalk 21. The metal box 33 has a removable top 35 secured by screws 36 and utilizes a foam seal or gasket 37 to prevent the entry of moisture.

With specific reference to FIG. 2, the control means 25 further comprises a bearing member 38 secured to one end of the box 33, which is adapted to receive and slidably guide an elongated eye bolt 39. The eye 39*a* of eye bolt 39 projects externally of the box 33, and the other end of the cable 22 includes a loop coupling 22*a* that is connected thereto. A collar 40 including a set screw 40*a* is secured to the eye bolt 39 externally of the box 33 in a fixed position to adjust the amount of projection of the eye bolt 39 internally of the box 33.

With continued reference to FIG. 2, the internal end of eye bolt 39 is threaded, and a nut 41 thereon serves to adjustably compress a coil spring 42 against the inner end of the box 33. This serves to force the eye bolt 39 to a position of maximum projection into the box 33, as determined by the adjustable collar 40.

A normally open electrical switch 43 is secured to the bottom of the box 33. Switch 43 is provided with a pivot shaft 43*a* that may be rotated to actuate the switch to a closed position. A linkage member 44 is secured to the pivot shaft 43*a* by a set screw 44*a* in a predetermined angular position relative to the eye bolt 39. A clevis 45 pivotally connects the outer end of the linkage member 44 and the extreme end of the eye bolt 39.

As constructed, it will be appreciated that engagement of the cable 22 and lateral deflection thereof will serve to pull the eye bolt 39, thus drawing it outward against the bias of coil spring 42 to the point that the electrical switch 43 is closed in the electrical sense. An electrical conduit 46 (FIGS. 1-3) enters the box 33 through a strain relief coupling 47 and is electrically connected to the switch 43. As shown in FIG. 1, the conduit 46 leads to an audible alarm 48 which, in the preferred embodiment consists of a horn. The horn 48 is secured within the cab 18 in a position in which it may easily be heard by the crane operator.

FIG. 7 is a schematic representation of the electric circuit used for the inventive apparatus. The conduit 46 electrically connects the switch 43 and horn 48 in series with a battery 49 or other source of voltage which may be the electrical system of the crane 11. The battery 49 is spliced into the conduit 46 in a manner not shown in FIG. 1.

With reference to FIGS. 1 and 6, a plurality of visual warning markers 50 are connected to the cable at the eye bolt of each of the support devices 23, as well as at an intermediate point between the support device 24 and its adjacent support device 23 on one side, and between the control means 25 and adjacent support device 23 on the opposite side. As shown in FIG. 6, each of these visual warning markers 50 comprises a triangular member 50*a* having a strap 50*b*, the extreme end of which comprises an enlarged head 50*c* that interlocks in a slot in the body 58 to form a loop coupling around the cable 22. A loop strap 51 may be used to fix the position of the marker 50 relative to the associated eye bolt 32. The markers 50 are preferably brightly colored and may include a reflector 50*d* for night use, the objective being to provide a visual warning to persons nearby as to the potential danger of the crane body 12.

In operation, the crane body 12 and boom 15 swing about the vertical axis 13 to position the boom 15 in selected positions for various lifting operations. The inventive safety apparatus, including the cable 22, supports 23, 24, control means 25, conduit 46, horn 48 and visual warning markers 50 all move with the crane body 12, the markers 50 offering visual warning to nearby persons as to the potential danger of the moving crane body 12. If the cable 22 engages an object or person during swinging movement, or if an object or person should engage the cable 22 for any reason, the cable 22 is laterally deflected, which alters the effective length of the cable and serves to draw the eye bolt 39 outward of the box 33. This in turn actuates the electrical switch 43, and based on its series connection with the battery 49 and horn 48, the latter is caused to operate, generating an audible signal which is immediately heard by the crane operator. The operator may then stop all operation of the crane to determine the cause of the alarm.

As an alternate to securing the cable 22 at one end to the fixed support 24 and at the other end to the control means 25, it would be possible to use a control means 25 at each end of the cable 22. This insures that cable deflection will be sensed at any point where the cable 22 is particularly long.

It will be observed from the foregoing that the safety apparatus is not only highly effective in preventing potential accidents involving the swinging crane body 12, but also is simple and economically manufactured, installed and operated. Further, the safety apparatus eliminates the previous approach of providing safety barricades around the periphery of the crane, which had to be initially placed and is thereafter moved for each position of the crane.

What is claimed is:

1. In a crane having a body defining opposite sides, a front end from which a crane boom is supported and extends forwardly, and a back end, the body being constructed for rotational swinging movement about a predetermined axis to position the crane boom in a desired location, the improvement which comprises:

cable means of predetermined length;

support means for supporting the cable means so that it extends around the opposite sides and back end of said crane body for movement therewith and in spaced relation thereto, said support means being constructed and arranged to resiliently support the cable means in a normal position under tension in such a way that the cable means may be deflected from its normal position to alter its effective length as it engages or is engaged by an object, and is returned to its normal position after engagement with the object ceases;

control means operatively connected to the cable means for generating an alarm signal when the cable means is deflected and its effective length is altered;

and alarm means operably connected to the control means for generating an alarm in response to the alarm signal.

2. The improvement defined by claim 1, wherein the control means comprises:

a member movable between first and second positions;

the cable means being connected to the movable member;

means for normally biasing the movable member to said first position and permitting movement thereof to said second position when the cable means is deflected; and normally open electromechanical switch means mechanically connected to the movable member and arranged to electrically close with movement of the movable member to said second position to generate said alarm signal.

3. The improvement defined by claim 2, wherein the alarm means comprises an electrically actuated audible alarm.

4. The improvement defined by claim 3, wherein the alarm means comprises a horn.

5. The improvement defined by claim 2, wherein the movable member comprises an elongated member having first and second ends and disposed for linear movement, and the control means further comprises linkage means for operably connecting the second end of the movable member to the electromechanical switch means.

6. The improvement defined by claim 5, wherein the electromechanical switch means comprises a shaft that is rotatable to close the switch means, and the linkage means is connected to transfer linear movement of the movable member to rotational movement of the shaft and thereby actuate the switch means.

7. The improvement defined by claim 5, wherein:

the control means further comprises a housing;

the first end of the elongated member projects through a side wall of the housing to a point external thereof, the cable means being connected to said first end;

the biasing means and electromechanical switch means being protectively disposed within the housing.

8. The improvement defined by claim 7, wherein the housing is constructed to resist the entry of moisture, and includes a removable top to permit access to the inside thereof.

9. The improvement defined by claim 7, wherein the elongated member comprises an eye bolt threaded at said first end and having an eye disposed at the second end.

10. The improvement defined by claim 9, wherein the biasing means comprises:

a coil spring disposed on the eye bolt within the housing;

and abutment means for compressing the spring against an internal wall of the housing.

11. The improvement defined by claim 10, wherein the abutment means comprises a nut adjustably placed on said threaded first end to vary the biasing force on the eye bolt.

12. The improvement defined by claim 11, which further comprises adjustable limit means disposed on said elongated member externally of the housing and abuttable thereagainst to establish said first position.

13. The improvement defined by claim 7, which further comprises:

electrical conduit means passing through a side wall of the housing for electrical connection to the electromechanical switch means;

and strain relief coupling means cooperating with said side wall for securing the conduit means thereto.

14. The improvement defined by claim 1, wherein:

the control means is constructed and arranged so that the alarm signal is no longer generated when the cable means is returned to its normal position; and the alarm means generates an alarm only during the period the alarm signal is generated.

15. The improvement defined by claim 1, wherein the cable means comprises a cable having first and second ends, one end being fixed to the support means and the other being operably connected to the control means.

16. The improvement defined by claim 15, wherein the support means comprises a plurality of eye bolt connectors secured to the crane body and projecting laterally outward therefrom, the cable extending through the eyes of the eye bolts and being movable relative thereto.

17. The improvement defined by claim 16, wherein each eye bolt connector comprises:

an eye bolt;

a connector bolt having a transverse bore therethrough for receiving the bolt portion of the eye bolt;

a collar member for receiving the connector bolt in interlocking relation;

and means for securing the collar member to the crane body.

18. The improvement defined by claim 17, which further comprises a visual warning member secured to a selected number of said eye bolts and cable means.

19. The improvement defined by claim 1, which further comprises a plurality of visual warning members connected to the cable means for providing a visual warning of the crane.

* * * * *